US006275098B1

(12) United States Patent
Uehara et al.

(10) Patent No.: US 6,275,098 B1
(45) Date of Patent: Aug. 14, 2001

(54) DIGITALLY CALIBRATED BANDGAP REFERENCE

(75) Inventors: Gregory T. Uehara, Honolulu, HI (US); Samuel Sheng, San Jose; Cormac Conroy, Sunnyvale, both of CA (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/411,342

(22) Filed: Oct. 1, 1999

(51) Int. Cl.[7] ..... G05F 3/16
(52) U.S. Cl. ..... 327/539; 327/307; 323/313
(58) Field of Search ..... 327/539, 540, 327/307; 323/313, 314, 315; 330/9

(56) References Cited

U.S. PATENT DOCUMENTS

| | | | | |
|---|---|---|---|---|
| 4,987,327 | * | 1/1991 | Fernandez et al. | 327/543 |
| 5,039,878 | * | 8/1991 | Armstrong et al. | 327/512 |
| 5,229,710 | * | 7/1993 | Kraus et al. | 323/313 |
| 5,517,134 | * | 5/1996 | Yaklin | 327/307 |
| 5,598,122 | * | 1/1997 | McClure | 327/538 |
| 5,936,392 | * | 8/1999 | Taylor | 327/543 |
| 6,014,020 | * | 1/2000 | Kuttner | 323/907 |
| 6,060,874 | * | 5/2000 | Doorenbos | 323/316 |
| 6,072,349 | * | 6/2000 | Pippin et al. | 327/525 |
| 6,201,379 | * | 3/2001 | MacQuigg et al. | 323/313 |

OTHER PUBLICATIONS

Krummenacher, Francois, et al, "SA 21.3: A High–Performance Autozeroed CMOS Opamp with 50$\mu$ V Offset", ISSCC97/Session 21/Amplifiers/Paper SA 21.3, 1997 IEEE International Solid–State Circuits Conference.

Song, Bang–Sup, "A Precision Curvature–Compensated CMOS Bandgap Reference", IEEE J. Solid–State Circuits, vol. SC–18, No. 6, pp. 634–643, Dec. 1983.

Michejda, John, et al., "A Precision CMOS Bandgap Reference", IEEE Journal of Solid–State Circuits, vol. SC–19, No. 6, Dec. 1984, pp. 1014–1021.

Ohara et al.; A CMOS Programmable Self–Calibrating 13–bit Eight–Channel Data Acquisition Peripheral; IEEE Journal of Solid–State Circuits, vol. SC–22, No. 6, Dec. 1987, pp. 930–938.

* cited by examiner

*Primary Examiner*—Timothy P. Callahan
*Assistant Examiner*—Terry L. Englund

(57) ABSTRACT

A system and method for compensating for a voltage offset between an inverting input and a noninverting input of an op amp to provide a stable bandgap reference. The method including measuring the voltage offset between the inverting input and the noninverting input of the op amp and searching for a compensating current input to the op amp that compensates for the voltage offset. A programmable current source is set to output the compensating current to the op amp.

18 Claims, 4 Drawing Sheets

DIGITALLY CALIBRATED BANDGAP REFERENCE

FIELD OF THE INVENTION

The present invention relates generally to providing a stable bandgap reference. More specifically, a technique for adjusting the offset of an op amp included in a bandgap reference circuit is disclosed.

BACKGROUND OF THE INVENTION

A stable voltage reference is required for a digital to analog converter (DAC) to output an accurate analog voltage. The accuracy of the analog voltage is particularly important for a DAC used in an ADSL line driver. The output power allowed for an ADSL system must stay within a tight range as defined by a standard (e.g. ITU 6.992.1 or 6.992.2). If the DAC in the ADSL line driver does not have a stable reference, the output power will not be well defined. The bandgap referencing technique has been widely employed for implementing a voltage reference source in bipolar integrated circuits, including circuits implemented in CMOS. FIG. 1 is a block diagram illustrating a conventional CMOS bandgap reference circuit. The area of transistor 102 is much larger than the area of transistor 104, usually by about a factor of 10. The emitters of the two transistors are connected to the noninverting and inverting inputs of op amp 106. The output of op amp 106 at node 110 is a reference voltage, $V_{ref}$, that, ideally, is a stable bandgap reference.

In practice, $V_{ref}$ also depends on the offset voltage of op amp 106, $V_{os}$, and the difference between the emitter-base voltages of transistors 102 and 104. $V_{ref}$ may be given by:

$$V_{BG} = V_{BE} + (\Delta V_{BE} + V_{OS}) \cdot \left(1 + \frac{R_1}{R_2}\right)$$

The op amp offset is a significant error source because the offset is generally not proportional to absolute temperature (PTAT). The op amp offset error and other error sources are described in more detail in "A Precision Curvature-Compensated CMOS Bandgap Reference" by Bang-Sup Song and Paul R. Gray, IEEE J. Solid State Circuits vol. SC-18, no. 6, pp. 634–643, Dec. 1983, which is herein incorporated by reference for all purposes.

Eliminating the op amp voltage offset or reducing its effect could greatly improve the stability of the bandgap reference. Different approaches have been suggested for doing that. For example, one possible solution is to use chopper stabilization to null out the op amp offset voltage. However, this technique creates undesirable switching transients and the reference voltage is valid only during a portion of the clock period. That is not preferable for a DAC used in an ADSL driver and in other applications that require a continuous and stable reference.

Another approach has been suggested for reducing the relative effect of the offset voltage by increasing the relative contribution of the bipolar transistor base-emitter voltages. By using an area-ratioed stack of three closely matched bipolar transistors, it is possible to produce a basic reference voltage that is three times the silicon bandgap voltage. That reduces the effect of the offset factor by a factor of 3. The bandgap voltage is then given by:

$$V_{BG} = 3V_{BE} + (3\Delta V_{BE} + V_{OS}) \cdot \left(1 + \frac{R_1}{R_2}\right)$$

Yet another approach is to trim, as with a laser, component values of certain elements within the op amp in order to reduce or eliminate the op amp offset. However, this is costly. Extra steps are required during manufacturing and testing to perform the trim function.

Although these techniques reduce variation resulting from the offset voltage of the op amp, it would be useful if a more effective technique could be developed. Specifically, a technique for compensating for the op amp offset that provides a continuous reference; that does not require removing or switching the op amp out of the bandgap reference circuit; and that does not require additional steps during manufacturing and testing, is needed.

SUMMARY OF THE INVENTION

A bandgap reference circuit that compensates for the op amp offset is disclosed. In one embodiment, a programmable current source is used to inject a current into the first stage output of a two stage op amp. An offset canceled comparator is used to determine the correct amount of current to be injected by the programmable current source. Significantly, this is accomplished without switching the op amp out of the bandgap reference circuit. In one embodiment, the bandgap reference source is used to provide a stable reference for a DAC used in an ADSL line driver. In order to maintain an accurate bandgap reference as the offset drifts over time, the current source may be reprogrammed whenever a system reset occurs.

It should be appreciated that the present invention can be implemented in numerous ways, including as a process, an apparatus, a system, a device, a method, or a computer readable medium such as a computer readable storage medium or a computer network wherein program instructions are sent over optical or electronic communication links. Several inventive embodiments of the present invention are described below.

In one embodiment, a compensated bandgap reference circuit includes an op amp having an inverting input and a noninverting input. The op amp is configured to output a bandgap reference based on base emitter voltage differences of a plurality of transistors. A programmable current source is configured to compensate for an offset voltage between the inverting input and a noninverting input. A comparator is configured to measure the offset voltage between the inverting input and the noninverting input and control the programmable current source.

In one embodiment, a compensated bandgap reference circuit includes an op amp having an inverting input and a noninverting input. A first transistor having a first emitter is connected to the noninverting input of the op amp. A second transistor having a second emitter is connected to the inverting input of the op amp. A comparator is configured to measure a voltage offset between the inverting input and the noninverting input. A programmable current generator is configured to inject a compensating current into the op amp. The programmed current is determined as a current that causes the comparator to measure the voltage offset to be less than a threshold.

In one embodiment, a method of compensating for a voltage offset between an inverting input and a noninverting input of an op amp to provide a stable bandgap reference includes measuring the voltage offset between the inverting input and the noninverting input of the op amp and searching for a compensating current input to the op amp that compensates for the voltage offset. A programmable current source is set to output the compensating current to the op amp.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

A detailed description of a preferred embodiment of the invention is provided below. While the invention is described in conjunction with that preferred embodiment, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail in order not to unnecessarily obscure the present invention.

Figure 1:
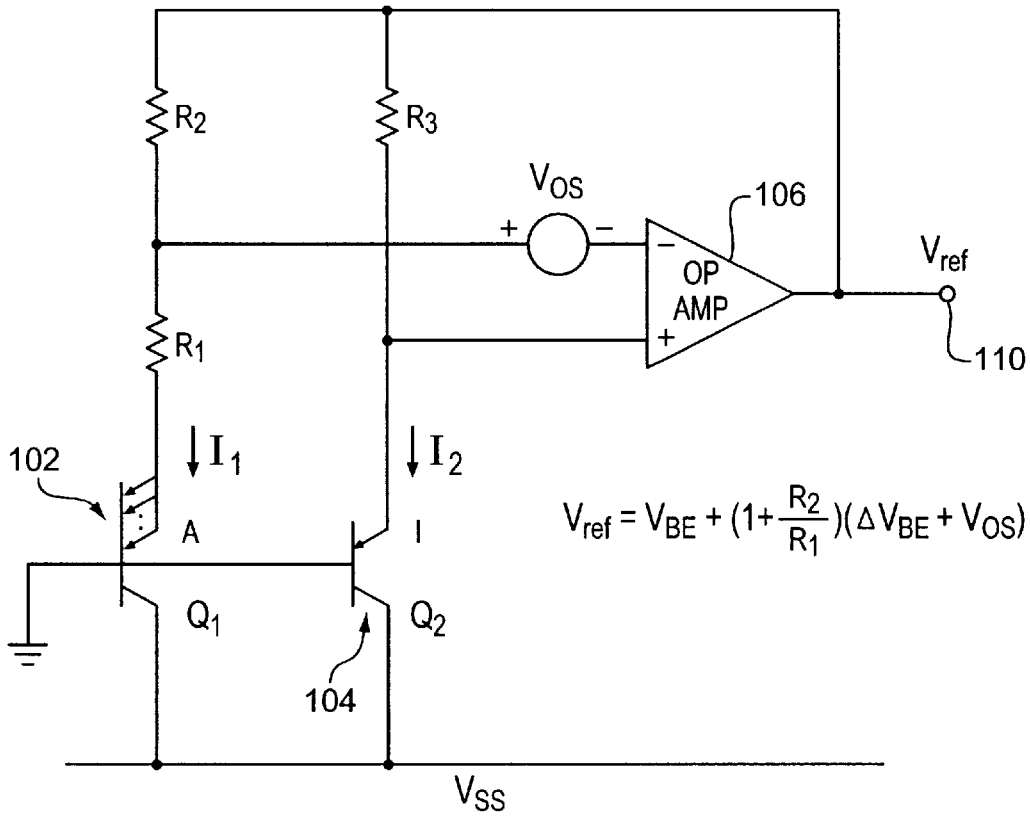
FIG. 1 is a block diagram illustrating a conventional CMOS bandgap reference circuit.
Figure 2:
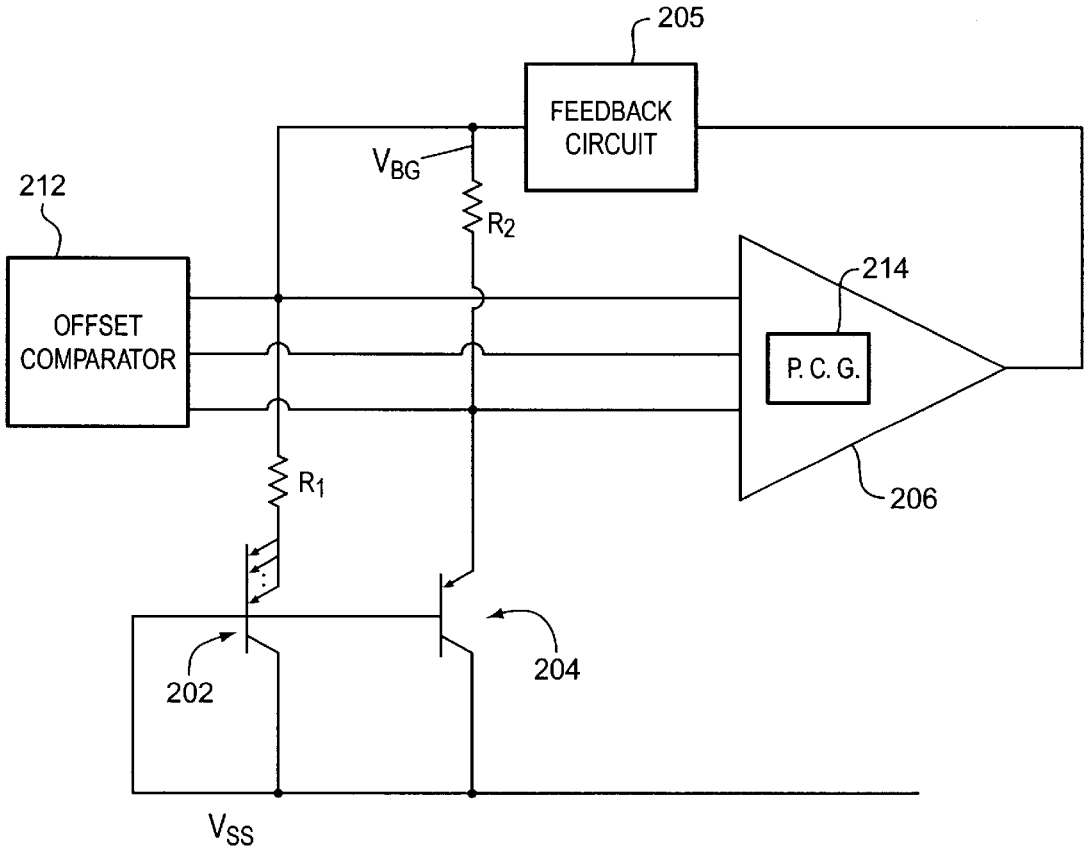
FIG. 2 is a block diagram illustrating at a high level the technique used to provide a stable bandgap reference.

FIG. 2 is a block diagram illustrating at a high level the technique used to provide a stable bandgap reference. Transistors 202 and 204 are configured with a feedback circuit 205 and op amp 206 in a manner similar to that shown in FIG. 1. The input referenced voltage offset (hereinafter referred to simply as "the offset") of the op amp is removed or reduced using an offset comparator 212 and programmable current source 214, which is built into op amp 206. In one embodiment, op amp 206 is a two stage op amp and programmable current source 214 is programmed to inject a current into the input of the second stage (at the output of the first stage) of the op amp to cancel the offset. During the period that the system is calibrated to cancel the offset, the programmable current source is programmed to inject different currents and the comparator 212 is used to determine whether the op amp offset has been successfully canceled. Comparator 212 compares the voltages at the inputs of the op amp, which ideally should be equal. Comparator 212 thus indicates whether the offset has been canceled by comparing the input voltages of the op amp. In contrast to other offset canceling techniques, no switching is required and adjustments to the offset canceling circuit (the programmable current generator) can be made without switching or removing the op amp from the bandgap reference circuit. Preferably, comparator 212 is an offset canceled comparator. One appropriate offset canceled comparator is described in Ohara et al., "A CMOS Programmable Self-Calibrating 13-bit Eight-Channel Data Acquisition Peripheral", IEEE J. Solid-State Circ., vol. SC-22, no. 6, pp. 930–938, Dec. 1987.

A current that causes the offset to be canceled is selected and used by the system until the system is recalibrated and the offset canceling current is reprogrammed.

Figure 3:
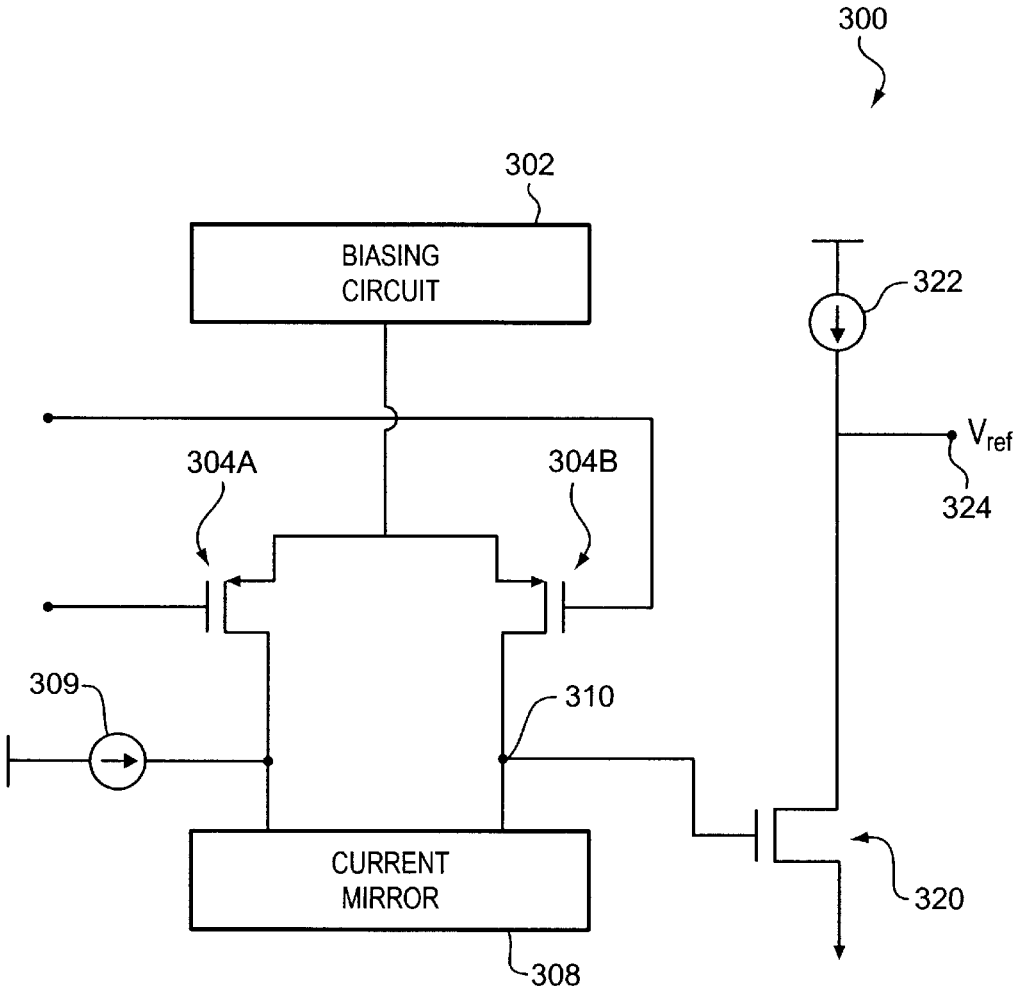
FIG. 3 is a diagram illustrating in detail how current is injected into the first stage of an op amp in one embodiment.

FIG. 3 is a diagram illustrating in detail how the current is injected into the first stage of op amp 206 in one embodiment. The first stage includes a biasing circuit 302 that biases a differential pair of transistors 304*a* and 304*b*. The gates of transistors 304*a* and 304*b* are the differential inputs to the first stage. The drains of the two transistors are connected to a current mirror 308. Programmable current generator 309 injects current on the drain side of one of the transistors in the differential pair. The injected current compensates for an offset voltage caused by irregularities in the manufactured circuit. The output of the first stage at node 310 is input to a second stage. The second stage includes transistor 320 and current source 322. The output of the second stage is at node 324.In some embodiments, an output buffer is added at the output node.

It should be noted that, although a two stage op amp is shown with the compensating current injected into the first stage output, other types of op amps with different numbers of stages are used in other embodiments. Current may similarly be injected by a programmable current source into one side of a differential pair as shown.

The characteristics of the op amp may change over time as the components age and the uncompensated offset may change. Therefore the bandgap reference system may be periodically reset. Again, no switching or removal of the op amp is required. The comparator is simply used as feedback for evaluating a new programmed current for the programmable current generator.

Figure 4:
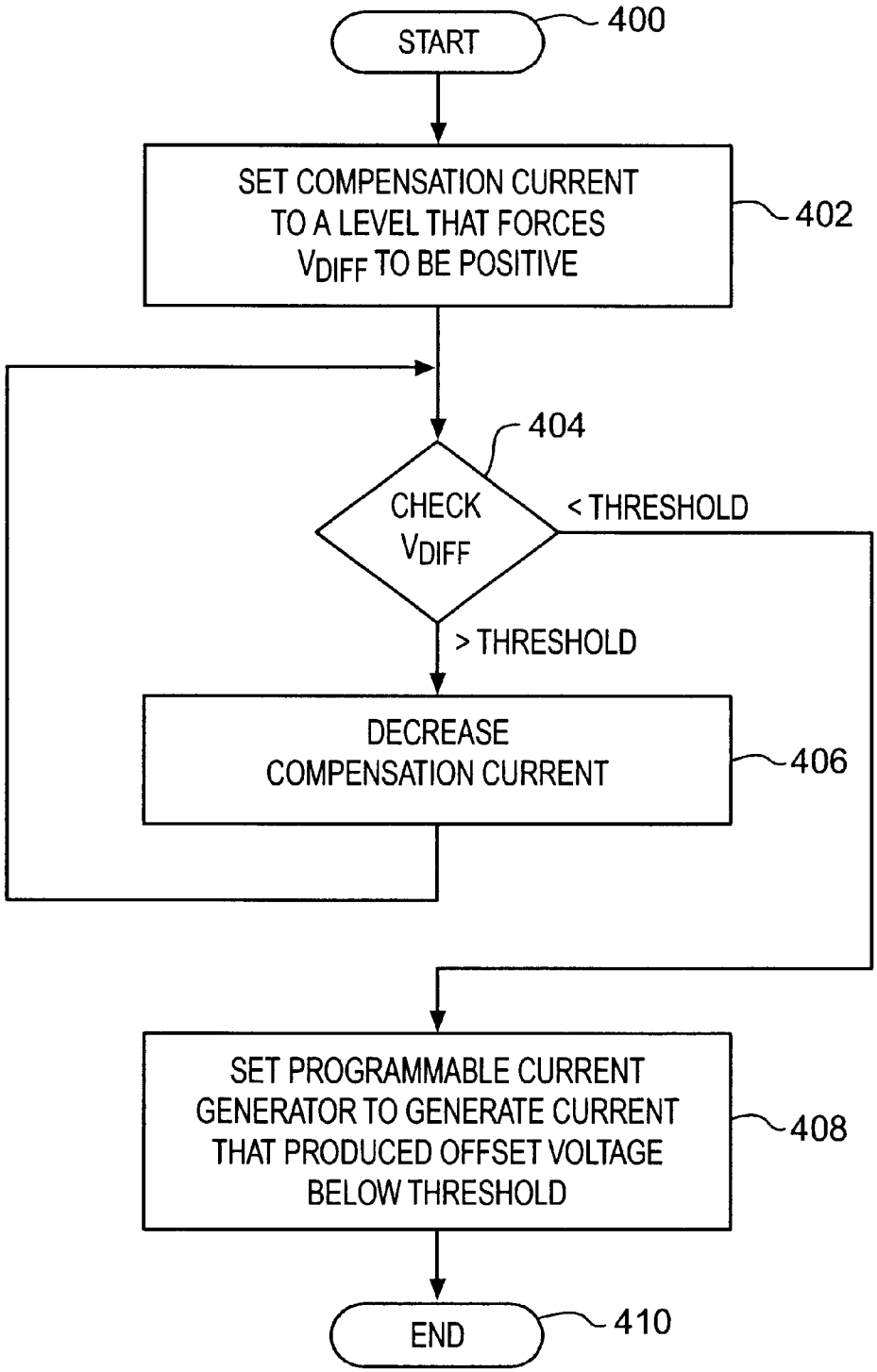
FIG. 4 is a flow chart illustrating a preferred method for programming the current source.

FIG. 4 is a flow chart illustrating a preferred method for programming the current source. The voltage between the two amplifier inputs is referred to as VDIFF. Prior to the calibration procedure, VDIFF is equal to the negative of the amplifier offset. The programming process starts at 400. In a step 402, the current is set to a level that forces VDIFF to a positive level. That is, the compensation current is set to a level that overcompensates for the amplifier offset. Therefore, it can be assumed that too much, and not too little compensation current has been added. Next, in a step 404, VDIFF is measured using the comparator.

If VDIFF is greater than a threshold (in one embodiment, the threshold is zero, in which case VDIFF greater than zero indicates a positive value), then control is transferred to a step 406 and the compensation current is decreased. After the compensation current is decreased, control is transferred back to step 404 and VDIFF is checked again. If VDIFF is determined to be less than the threshold in step 404, then control is transferred to a step 408 where the programmable current generator is set to generate the current that produced this transition in the sign of VDIFF. Thus, the compensation current is decreased by small increments until VDIFF transitions from being positive to being slightly negative (almost zero). The compensation current that results in the almost zero VDIFF is used to compensate for the amplifier offset.

The search method for a compensation current that results in a near zero VDIFF is but one of many search methods used in different embodiments. For example, the compensation current can just as well be first set to a level that results in an initial value of VDIFF that is definitely negative. The compensation current can then be increased gradually until VDIFF transitions to be a very small positive value. Other more complicated methods such as successive approximation may be used to more quickly converge on an appropriate compensation current. The method described above is preferred for its simplicity. Setting the offset current initially to a very high value and slowly decreasing it simplifies the design. Adjustments are required in only one direction and the comparator need not control the adjustments based on the sign of the measured offset. In some embodiments, a standard technique is used to search for an appropriate compensation current.

A compensated bandgap reference has been described. A programmable current source injects a current in output of the first stage of the op amp used in the bandgap reference circuit. A comparator is used to determine when the injected current successfully compensates for the op amp offset. Using the techniques described herein, a better bandgap reference was obtained and power variance for an ADSL driver was reduced from about 5%-7% to about 1%-2%.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A compensated bandgap reference circuit comprising:

an op amp having an inverting input and a noninverting input wherein the op amp is configured to output a bandgap reference based on base emitter voltage differences of a plurality of transistors;

a digitally programmable current source configured to compensate for an offset voltage between the inverting input and the noninverting input; and a comparator configured to measure the offset voltage between the inverting input and the noninverting input and to digitally control the programmable current source.

2. A compensated bandgap reference circuit comprising:

an op amp having an inverting input and a noninverting input, wherein the op amp provides a bandgap reference voltage output;

a first transistor having a first emitter connected to the noninverting input of the op amp;

a second transistor having a second emitter connected to the inverting input of the op amp;

a comparator configured to measure a voltage offset between the inverting input and the noninverting input; and a digitally programmable current generator configured to inject a programmed compensating current into the op amp wherein the programmed compensating current is determined as a current that causes the comparator to measure the voltage offset to be less than a threshold.

3. A compensated bandgap reference circuit as recited in claim 2 wherein the first emitter is connected to the noninverting input of the op amp via a resistor network.

4. A compensated bandgap reference circuit as recited in claim 2 wherein the programmable current generator is built into the op amp.

5. A compensated bandgap reference circuit as recited in claim 2 wherein the bandgap reference voltage is continuously output.

6. A compensated bandgap reference circuit as recited in claim 2 wherein the comparator measures the voltage offset between the inverting input and the noninverting input without removing the inverting input and the noninverting input from the bandgap reference circuit.

7. A compensated bandgap reference circuit as recited in claim 2 wherein the compensating current is injected in the first stage output of a two stage op amp.

8. A compensated bandgap reference circuit as recited in claim 2 wherein the op amp is a two stage op amp.

9. A compensated bandgap reference circuit as recited in claim 2 wherein the op amp is a single stage op amp.

10. A compensated bandgap reference circuit as recited in claim 2 wherein the op amp has more than two stages.

11. A compensated bandgap reference circuit as recited in claim 2 wherein the bandgap reference voltage is used in an ADSL analog front end integrated circuit.

12. A compensated bandgap reference circuit as recited in claim 2 wherein the bandgap reference voltage is used to provide stable reference to control transmit power in an integrated circuit for communications.

13. A method of compensating for a voltage offset between an inverting input and a noninverting input of an op amp to provide a stable bandgap reference comprising:

measuring the voltage offset between the inverting input and the noninverting input of the op amp;

searching for a compensating current input to the op amp that compensates for the voltage offset; and setting a digitally programmable current source to output the compensating current to the op amp.

14. A method of compensating for a voltage offset between an inverting input and a noninverting input of an op amp to provide a stable bandgap reference as recited in claim 13 wherein searching for a compensating current input includes initializing the programmable current source to output a large initial current and slowly decreasing the programmable current source output until the measured voltage offset is below a threshold.

15. A method of compensating for a voltage offset between an inverting input and a noninverting input of an op amp to provide a stable bandgap reference as recited in claim 13 wherein searching for a compensating current input includes initializing the programmable current source to output a small initial current and slowly increasing the programmable current source output until the measured voltage offset is above a threshold.

16. A method of compensating for a voltage offset between an inverting input and a noninverting input of an op amp to provide a stable bandgap reference as recited in claim 13 wherein searching for a compensating current input includes initializing the programmable current source to output an initial current that over compensates for the amplifier offset and slowly decreasing the programmable current source output until the amplifier offset is appropriately compensated.

17. A method of compensating for a voltage offset between an inverting input and a noninverting input of an op amp to provide a stable bandgap reference as recited in claim 13 wherein searching for a compensating current input includes initializing the programmable current source to output an initial current that under compensates for the amplifier offset and slowly increasing the programmable current source output until the amplifier offset is appropriately compensated.

18. A method of compensating for a voltage offset between an inverting input and a noninverting input of an op amp to provide a stable bandgap reference as recited in claim 13 wherein searching for a compensating current input includes using a successive approximation process to determine a compensating current input that reduces the measured voltage offset below a threshold.

* * * * *